US005284372A

United States Patent [19]

Lin

[11] Patent Number: 5,284,372

[45] Date of Patent: Feb. 8, 1994

[54] LOCKING MECHANISM OF A LATCH BOLT

[76] Inventor: Jui-Chang Lin, No. 55-10, Been-Chou Rd., Kangshan, Kaohsiung Hsien, Taiwan

[21] Appl. No.: 53,854

[22] Filed: Apr. 29, 1993

[51] Int. Cl.[5] ..... E05C 1/16

[52] U.S. Cl. ..... 292/336.3; 292/357; 292/169.17; 292/169.18

[58] Field of Search ..... 292/336.3, 150, 357, 292/169.17, 169.18, 359

[56] References Cited

U.S. PATENT DOCUMENTS 3,079,189 2/1963 Russell et al. ..... 292/169.17
4,966,399 10/1990 Lin ..... 292/359
5,074,607 12/1991 Lin ..... 292/359
5,190,327 3/1993 Lin ..... 292/357 X

*Primary Examiner*—Richard E. Moore
*Attorney, Agent, or Firm*—Jacobson, Price, Holman & Stern

[57] ABSTRACT

A latch bolt includes an outer knob and an inner knob, a tube rotatably engaged in the inner knob, a button having one end engaged in the tube and having the other end extendible outward of the inner knob, and a barrel rotatably received in the tube. The latch bolt is locked when the button is depressed inward of the inner knob and is unlocked when the inner knob is rotated. The latch is also unlocked when a key is inserted into the outer knob and when the outer knob is rotated.

3 Claims, 3 Drawing Sheets

LOCKING MECHANISM OF A LATCH BOLT

BACKGROUND OF THE INVENTION (a) Field of the Invention

The present invention relates to a locking mechanism, and more particularly to a locking mechanism of a latch bolt.

(b) Description of the Prior Art

Typical latch bolts comprise an inner knob having a handle rotated in order to lock the latch bolt, and an outer knob into which a key is engaged in order to lock the latch bolt, such types of latch bolts include a rather complicated configuration.

The present invention has arisen to mitigate and/or obviate the afore-described disadvantages of the conventional latch bolts.

SUMMARY OF THE INVENTION

The primary objective of the present invention is to provide a latch bolt which includes a greatly simplified configuration and can be easily locked from the inner knob thereof.

In accordance with one aspect of the present invention, there is provided a latch bolt comprising an outer knob including an axle extended therefrom, a lever extended outward from the axle, an inner cap including a hub formed therein, an inner knob including a stub rotatably engaged in the hub of the inner cap and including at least one bulge extended inwards thereof, a plate secured to the inner cap and disposed between the outer knob and the inner cap and including an opening and two notches formed in a middle portion thereof, a tube engaged in the stub of the inner knob and including a gap longitudinally formed therein for engaging with the bulge of the stub such that the tube is movable longitudinally in the stub and is prevented from rotating in the stub, the tube including an orifice and a mouth formed therein, a button including a first end slidably engaged in the tube and a second end extendible outward of the inner knob, a channel formed in the button, a retainer engaged in the channel and including a tapered end portion engageable with the orifice of the tube, the retainer being engaged with the axle and rotated in concert with the axle, means for biasing the tapered end portion of the retainer to engage with the orifice of the tube, a barrel rotatably received in the tube and engaged with the button and including a pair of legs extended toward the outer knob and including a protrusion extended radially outward therefrom for engaging with the mouth of the tube, a follower engaged on the axle and slidably engaged with the legs of the barrel, means biased between the follower and the barrel for biasing the barrel and the button toward the inner knob; the legs of the barrel being engaged with the notches of the plate and the tapered end portion of the retainer being biased to engage with the orifice of the tube when the button is depressed inward of the inner knob such that the axle is locked and may not be rotated by the outer knob, and the retainer being caused to move inwards of the tube due to the tapered end portion thereof when tube is rotated relative to the button by the inner knob, the barrel and the button being biased toward the inner knob when the retainer moves inward of the tube, whereby, the legs of the barrel are disengaged from the notches of the plate.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
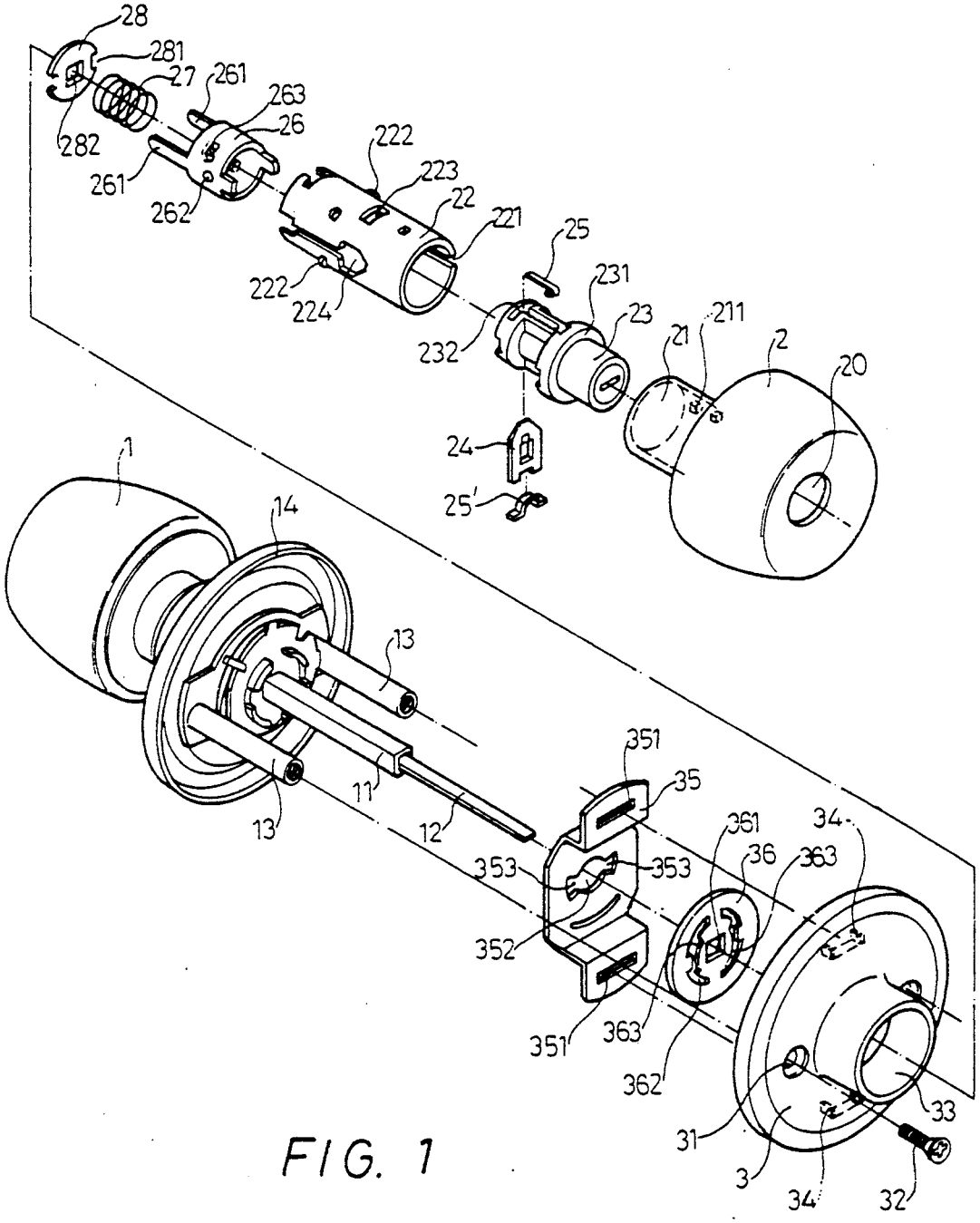
FIG. 1 is an exploded view of a latch bolt in accordance with the present invention.
Figure 2:
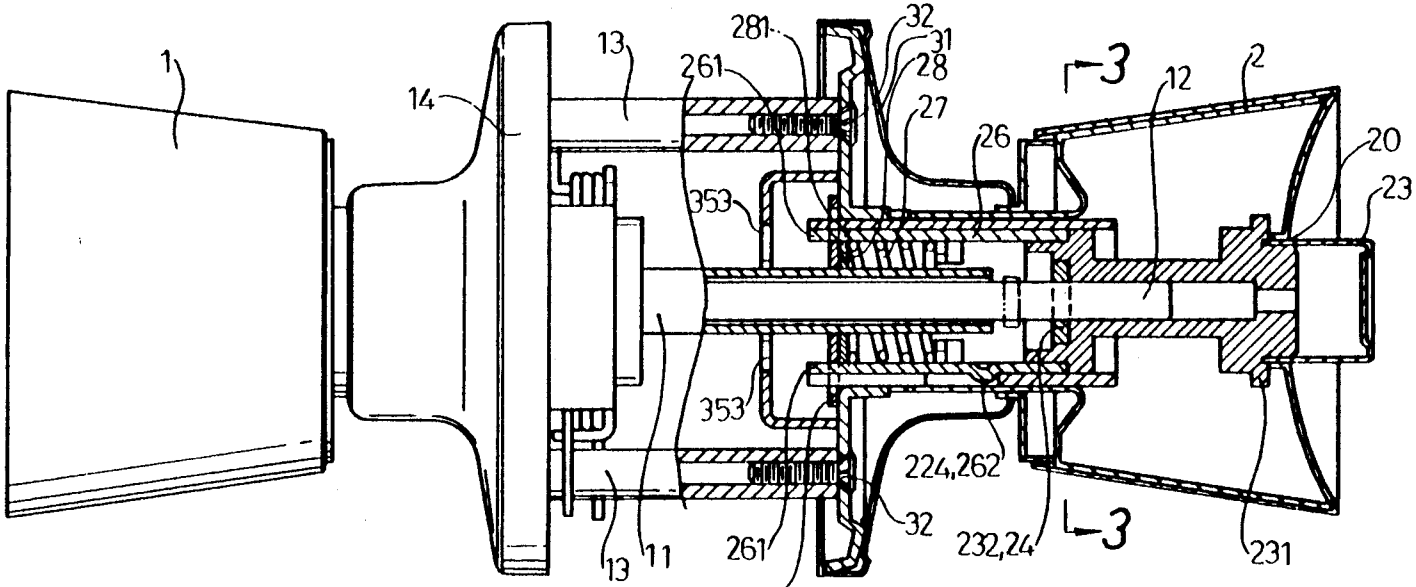
FIG. 2 is a partial cross sectional view of the latch bolt.
Figure 3:
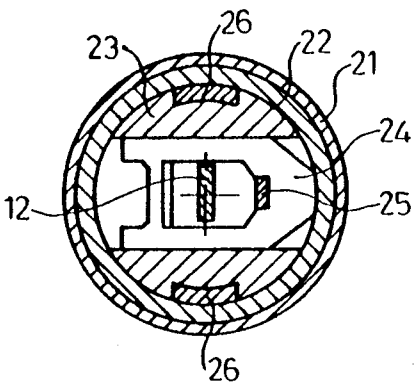

Referring to the drawings and initially to FIGS. 1 to 3, a latch bolt in accordance with the present invention comprises generally an outer knob 1 and an inner knob 2 coupled together for operating the latch bolt, the outer knob 1 includes a conventional shaft 11, a lever 12, two or more extensions 13, a cap 14 and other conventional parts, the present invention is related to the inner knob 2.

The inner knob 2 includes a cap 3, one or more screws 32 threaded through the holes 31 of the cap 3 and threadedly engaged with the extensions 13 for coupling the cap 3 to the cap 14, a hub 33 formed in the cap 3, and two pairs of projections 34 extended from the cap 3 and extended toward the outer knob 1. The inner knob 2 includes a stub 21 rotatably engaged in the hub 33 of the cap 3, two bulges 211 extend inwards of the stub 21, a plate 35 includes a pair of ears each having a slot 351 formed therein for engaging with the projections 34 such that the plate 35 can be secured to the cap 3, an opening 352 is formed in the middle portion of the plate 35 and two notches 353 are oppositely formed in the plate 35 and communicated with the opening 352, the shaft 11 is extended through the opening 352 of the plate 35. A disc 36 is disposed between the plate 35 and the cap 3 and includes a square aperture 361 formed in the center for engaging with the shaft 11, and includes two pairs of slots 362, 363 formed therein.

Figure 4:
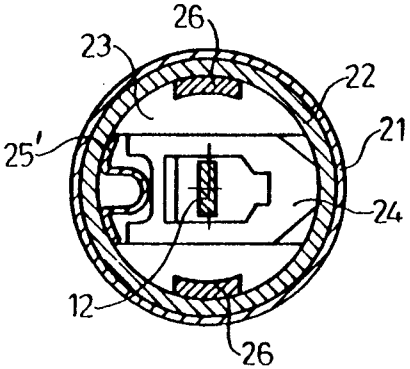
FIGS. 3 and 4 are cross sectional views taken along lines 3—3 of FIG. 2.

A tube 22 is engaged in the stub 21 of the inner knob 2 and includes a gap 221 longitudinally formed therein for engaging with the bulges 211 of the stub 21 such that the tube 22 is movable longitudinally along the stub 21. The tube 22 includes two stops 222 extended outward therefrom for engaging with the end portion of the stub 21 so as to limit the movement of the tube 22 relative to the stub 21. An orifice 223 and a mouth 224 are formed in the tube 22. A button 23 has one end slidably engaged in the tube 22 and has the other end extended outward through the hole 20 of the inner knob 2, a ring 231 is formed on the outer peripheral portion of the button 23 for engaging with the inner portion of the hole 20 of the inner knob 2, best shown in FIG. 2. A channel 232 is formed in the button 23, a retainer 24 is engaged in the channel 232 of the button 23, and two springs 25, 25' engaged with the retainer 24 for causing the tapered end portion of the retainer 24 to engage or to disengage from the orifice 223 of the tube 22, as shown in FIGS. 3 and 4.

A barrel 26 is engaged in the tube 22 and includes a pair of legs 261 extended therefrom and extended through one pair of the slots 363, and includes a protrusion 262 extended radially outward therefrom for engaging with the mouth 224 of the tube 22, a swelling 263 is extended inwards of the barrel 26 for engaging with a spring 27 which biases the barrel 26 to engage with the button 23. The legs 261 of the barrel 26 are caused to engage with the notches 353 of the plate 35 when the button 23 is depressed inwards of the inner knob 2, and are disengaged from the notches 353 by the spring 27. A follower 28 includes a square hole 282 formed therein for engaging with the axle 11 and two depressions 281 engaged with the legs 261 of the barrel 26. The follower 28 is biased by the spring 27 to contact with the disc 36.

In operation, as shown in FIG. 2, the barrel 26 and the button 23 are biased by the spring 27 such that the button 23 is biased outwards of the inner knob 20; at this moment, the legs 261 of the barrel 26 are disengaged from the notches 353 of the plate 35, and the axle 11 is rotatable by the outer knob 1; when the inner knob 2 is rotated, the tube 22 is rotated by the engagement between the bulges 211 of the stub 21 and the gap 221 of the tube 22, the barrel 26 is rotated by the tube 22 by the engagement between the protrusion 262 and the mouth 224, and the follower 28 is rotated by the barrel 26 due to the engagement between the notches 281 of the follower 28 and the legs 261 of the barrel 26. It is to be noted that, at this moment, as shown in FIGS. 3 and 4, the retainer 24 is received in the tube 22.

Figure 5:
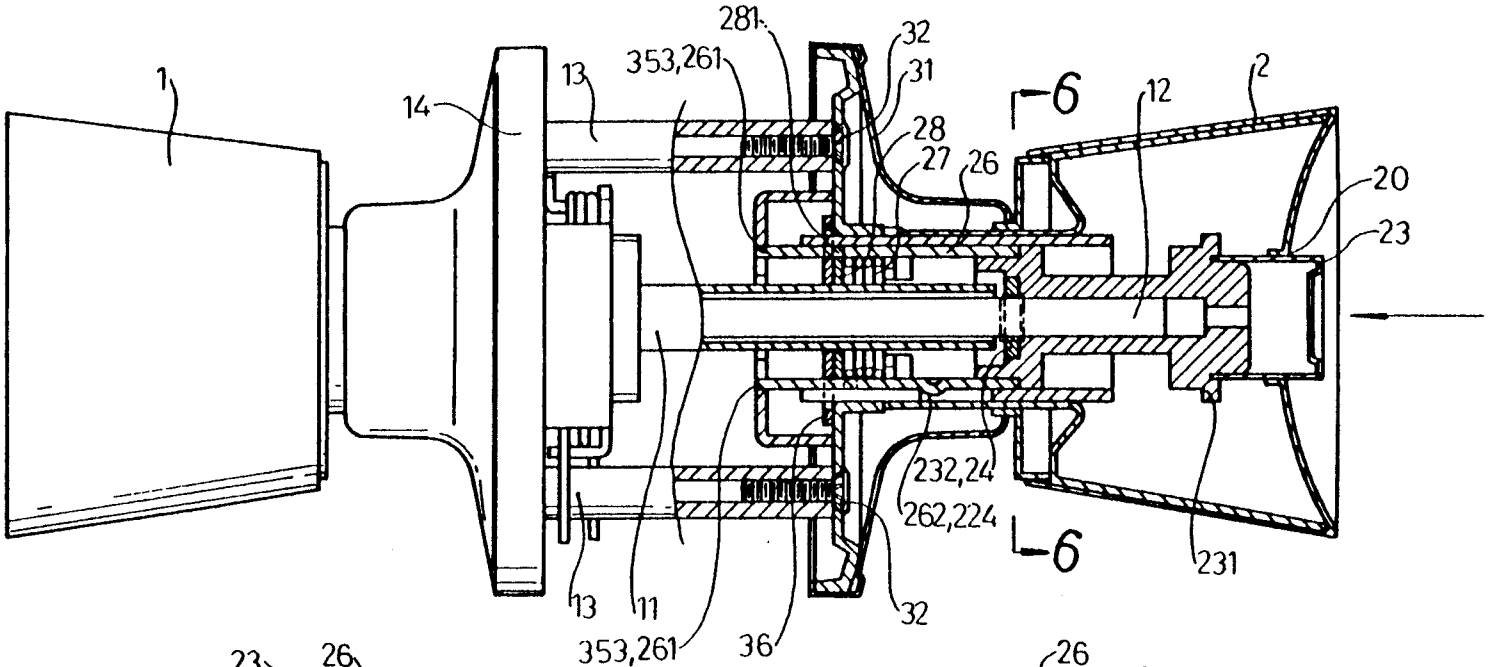
FIG. 5 is a partial cross sectional view similar to FIG. 2, illustrating the operation of the latch bolt.

As shown in FIG. 5, when the button 23 is depressed inwards of the inner knob 2, the barrel 26 is pushed toward the outer knob 1 such that the legs 261 of the barrel 26 are caused to engage with the notches 353 of the plate 35 and such that the barrel 26 and the follower 28 can not be rotated, whereby, the outer knob 1 can not be rotated; at this moment, the retainer 24 is biased by the springs 25, 25' to engage with the orifice 223 of the tube 22 when the retainer 24 is aligned with the orifice 223 of the tube 22. It is to be noted that, at this moment, the tube 22 can be rotated relative to the barrel 26 by the outer knob 2 because the protrusion 262 is smaller than the mouth 224 and can move within the mouth 224 such that the inner knob 2 can still be rotated.

Figure 7:
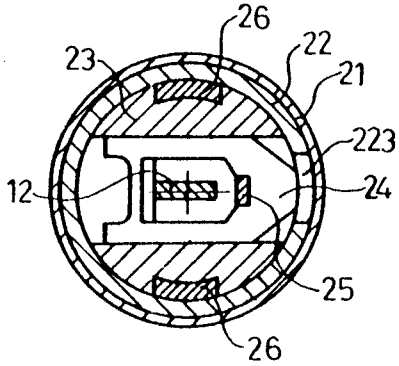
FIGS. 6 and 7 are cross sectional views taken along lines 6—6 of FIG. 5, illustrating the operations of the latch bolt.
Figure 6:
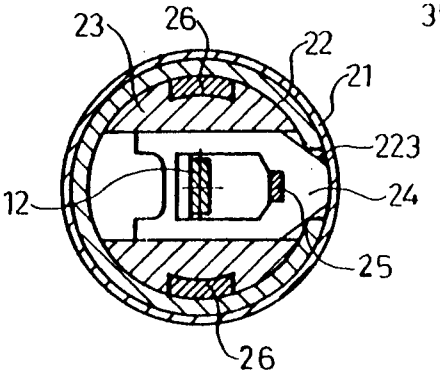

As shown in FIG. 6, when the tube 22 is rotated relative to the barrel 26, the retainer 24 can be caused to move inwards of the tube 22 to the position as shown in FIG. 7 by the tapered end portion thereof, whereby, the retainer 24 can be caused to disengage from the orifice 223 of the tube 22. The barrel 26 is then pushed toward the inner knob 2 by the spring 27 until the legs 261 of the barrel 26 are disengaged from the notches 353 of the plate 35, the tube 22, the barrel 26 and thus the follower 28 can be rotated by the inner knob 2 in order to rotate the axle 11.

When it is required to unlock the latch bolt via the outer knob 1, as shown in FIG. 7, a key is required to be inserted into the outer knob 1 in order to rotate the lever 12 which pushes the retainer 24 to disengage from the orifice 223 of the tube 22, the legs 261 of the barrel 26 can thus be disengaged from the notches 353 of the plate 35, such that the latch bolt is unlatched.

Accordingly, the latch bolt in accordance with the present invention comprises a greatly simplified configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A latch bolt comprising an outer knob including an axle extended therefrom, a lever extended outward from said axle, an inner cap including a hub formed therein, an inner knob including a stub rotatably engaged in said hub of said inner cap and including at least one bulge extended inwards thereof, a plate secured to said inner cap and disposed between said outer knob and said inner cap and including an opening and two notches formed in a middle portion thereof, a tube engaged in said stub of said inner knob and including a gap longitudinally formed therein for engaging with said bulge of said stub such that said tube is movable longitudinally in said stub and is prevented from rotating in said stub, said tube including an orifice and a mouth formed therein, a button including a first end slidably engaged in said tube and a second end extendible outward of said inner knob, a channel formed in said button, a retainer engaged in said channel and including a tapered end portion engageable with said orifice of said tube, said retainer being engaged with said axle and rotated in concert with said axle, means for biasing said tapered end portion of said retainer to engage with said orifice of said tube, a barrel rotatably received in said tube and engaged with said button and including a pair of legs extended toward said outer knob and including a protrusion extended radially outward therefrom for engaging with said mouth of said tube, a follower engaged on said axle and slidably engaged with said legs of said barrel, means biased between said follower and said barrel for biasing said barrel and said button toward said inner knob; said legs of said barrel being engaged with said notches of said plate and said tapered end portion of said retainer being biased to engage with said orifice of said tube when said button is depressed inward of said inner knob such that said axle is locked and may not be rotated by said outer knob, and said retainer being caused to move inwards of said tube due to said tapered end portion thereof when tube is rotated relative to said button by said inner knob, said barrel and said button being biased toward said inner knob when said retainer moves inward of said tube, whereby, said legs of said barrel are disengaged from said notches of said plate.

2. A latch bolt according to claim 1, wherein said mouth of said tube includes a size larger than that of said protrusion of said barrel such that said protrusion is movable in said mouth.

3. A latch bolt according to claim 1, wherein said lever is extended through said retainer, said retainer is caused to move inward of said tube when said lever is rotated.

* * * * *